US006623338B2

(12) United States Patent
Pettit et al.

(10) Patent No.: US 6,623,338 B2
(45) Date of Patent: Sep. 23, 2003

(54) METHOD OF ABRADING SILICON SUBSTRATE

(75) Inventors: Thomas E. Pettit, Corvallis, OR (US); James Denning Smith, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 3 days.

(21) Appl. No.: 10/023,784

(22) Filed: Dec. 17, 2001

(65) Prior Publication Data

US 2002/0049025 A1 Apr. 25, 2002

Related U.S. Application Data

(62) Division of application No. 09/532,102, filed on Mar. 21, 2000.

(51) Int. Cl.[7] ..... B24C 3/04

(52) U.S. Cl. ..... 451/41; 451/28; 451/75; 451/99; 451/446; 251/121

(58) Field of Search ..... 451/28, 38, 41, 451/75, 89, 39, 90, 99, 101, 446; 251/121, 205, 213; 29/90.01; 239/379; 406/14, 146; 15/95; 134/7

(56) References Cited

U.S. PATENT DOCUMENTS

| | | | | | |
|---|---|---|---|---|---|
| 2,953,875 | A | * | 9/1960 | Mead | 451/75 |
| 3,343,304 | A | | 9/1967 | Eppler | |
| 3,852,918 | A | * | 12/1974 | Black | 451/99 |
| 3,994,097 | A | | 11/1976 | Lamb | |
| 4,776,794 | A | | 10/1988 | Meller | |
| 5,199,229 | A | | 4/1993 | Herold et al. | |
| 5,308,442 | A | | 5/1994 | Taub et al. | |
| 5,387,314 | A | | 2/1995 | Baughman et al. | |
| 5,441,593 | A | | 8/1995 | Baughman et al. | |
| 5,531,634 | A | * | 7/1996 | Schott | 451/39 |
| 5,605,497 | A | | 2/1997 | Pickard | |
| 5,947,800 | A | * | 9/1999 | Fring | 451/99 |

* cited by examiner

*Primary Examiner*—Joseph J. Hail, III
*Assistant Examiner*—Anthony Ojini

(57) ABSTRACT

A method of abrading a portion of a silicon substrate includes fluidizing abrasive particulate material with a first gas within a storage container, combining the gas fluidized abrasive particulate material with a stream of a second gas to provide a stream of the gas fluidized abrasive particulate material, and directing the stream of the gas fluidized abrasive particulate material at the silicon substrate to abrade the portion of the silicon substrate.

15 Claims, 5 Drawing Sheets

METHOD OF ABRADING SILICON SUBSTRATE

CROSS REFERENCE TO RELATED APPLICATION(s) and add the paragraph:

This is a divisional of copending application Ser. No. 09/532,102 filed on Mar. 21, 2000, which is hereby incorporated by reference herein.

THE FIELD OF THE INVENTION

The present invention relates generally to a system for delivering abrasive particulate material under pressure, and more particularly to a system which utilizes a pressurized source to fluidize and deliver abrasive particulate material for abrading a surface of another material, such as for abrading a portion of a silicon substrate of an ink-jet printhead to thereby form an ink fill slot in the silicon substrate.

BACKGROUND OF THE INVENTION

A conventional process, commonly referred to as sandblasting, combines abrasive particulate material, such as sand, with a pressurized source of gas, for example, air, to form an abrasive mixture under pressure and directs the abrasive mixture under pressure at a surface. Such a conventional sandblasting process is typically used for cleaning, polishing, or abrading the surface at which the abrasive mixture is directed. Existing sandblasting systems typically include a storage container adapted to contain the abrasive particulate material therein, and a pressure line through which the pressurized source of gas is directed and into which the abrasive particulate material is fed by gravity flow from the storage container.

More particularly, sandblasting has been employed to form an ink fill slot in a silicon substrate of an ink-jet printhead. Existing sandblasting systems employed for forming the ink fill slot typically rely on gravity flow, vibration of the storage container, and/or modulation of the pressure line to ensure discharge of the abrasive particulate material from the storage container, through a metering orifice, and into the pressure line. The vibration and/or modulation in these existing sandblasting systems, however, results in chaotic behavior, or inconsistent flow, of the abrasive particulate material through the metering orifice. This chaotic behavior resulting when the ink fill slot is formed with existing sandblasting systems is identified by random size and shape variations of the ink fill slot. Since the ink fill slot provides a supply of ink to a printing element of the ink-jet printhead during a printing process, a distance from the ink fill slot to the printing element effects the supply of ink to the printing element. Size and shape variations in the ink fill slot, therefore, can degrade printing performance.

Accordingly, a need exists for a system for delivering abrasive particulate material under pressure which provides consistent flow of the abrasive particulate material from a storage container, through a metering orifice, and into an output pressure line. In particular, there is a need for a method for more uniformly forming an ink fill slot in a silicon substrate of an ink-jet printhead.

SUMMARY OF THE INVENTION

One aspect of the present invention provides a method of abrading a portion of a silicon substrate. The method includes fluidizing abrasive particulate material with a first gas within a storage container, combining the gas fluidized abrasive particulate material with a stream of a second gas to provide a stream of the gas fluidized abrasive particulate material, and directing the stream of the gas fluidized abrasive particulate material at the silicon substrate to abrade the portion of the silicon substrate.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
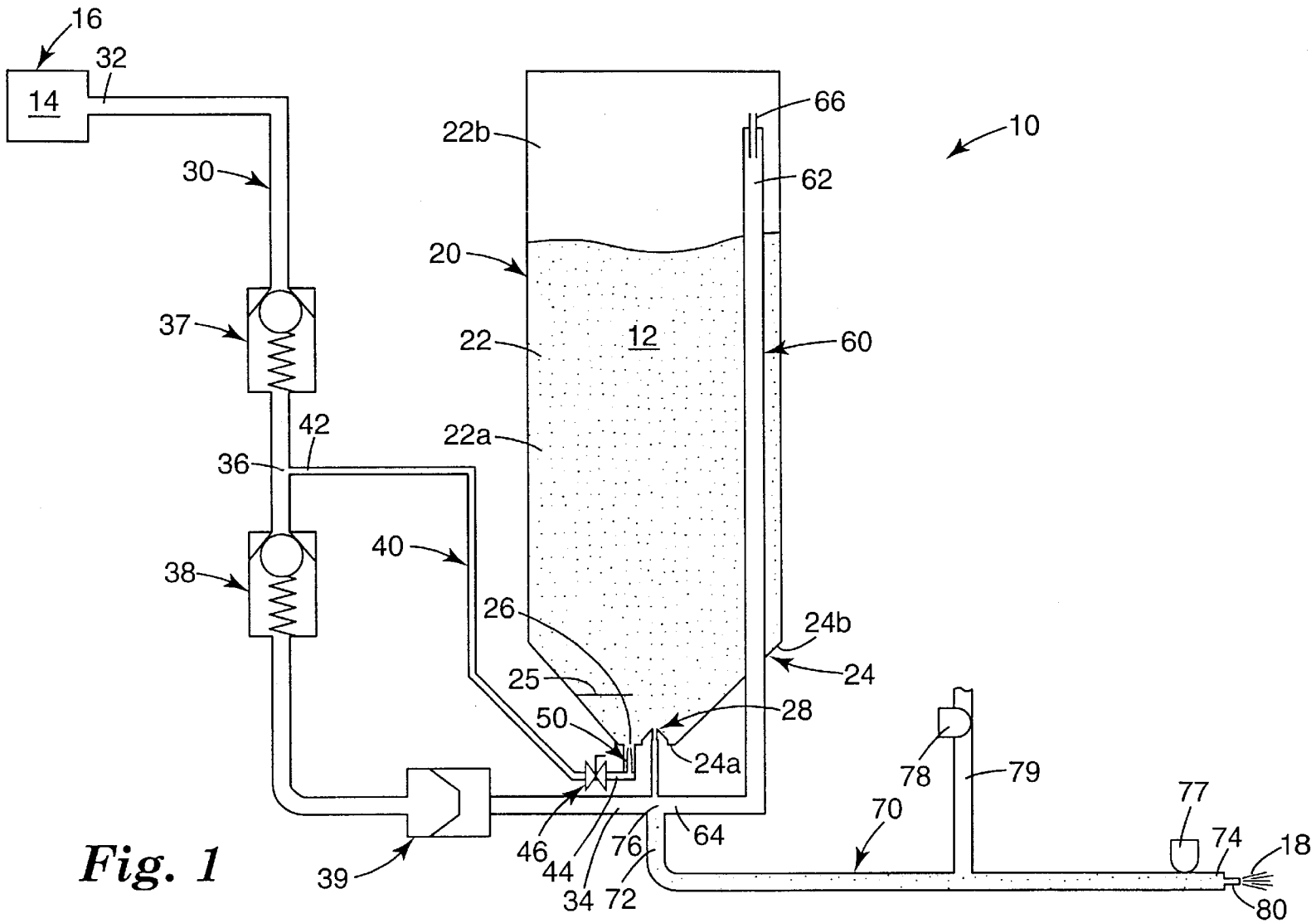
FIG. 1 is a schematic view of one embodiment of a pressurized delivery system for abrasive particulate material according to the present invention.

FIG. 1 illustrates one embodiment of a pressurized delivery system 10 for abrasive particulate material 12 according to the present invention. Pressurized delivery system 10 includes a storage container 20, an input pressure line 30, a fluidizing pressure line 40, an inlet valve 50, a back-pressure pressure line 60, and an output pressure line 70. Storage container 20 defines an interior space 22 adapted to contain abrasive particulate material 12 therein. When abrasive particulate material 12 is deposited within storage container 20, an occupied portion 22*a* and unoccupied portion 22*b* of interior space 22 are defined. Unoccupied portion 22*b* includes a portion of interior space 22 devoid of abrasive particulate material 12. Abrasive particulate material 12 may include sand, aluminum oxide, silicon carbide, quartz, diamond dust, or any other suitable abrasive material in particulate form or particulate material having suitable abrasive qualities for a desired application of pressurized delivery system 10.

In one embodiment, storage container 20 is generally cylindrical in shape and includes a base 24 having an inlet opening 26 and an outlet opening 28 defined therein. Outlet opening 28 functions as a metering orifice through which abrasive particulate material 12 is fed to output pressure line 70. In one embodiment, inlet opening 26 is adjacent to outlet opening 28 and a baffle 25 is provided above inlet opening 26. In addition, base 24 of storage container 20 includes a bottom wall 24*a*, in which inlet opening 26 and outlet opening 28 are formed, and an inwardly, downwardly sloping side wall 24*b*. Inwardly, downwardly sloping side wall 24*b* facilitates gravity flow of abrasive particulate material 12 downward within storage container 20 toward outlet opening 28.

Input pressure line 30 has a first end 32 and a second end 34. First end 32 of input pressure line 30 is adapted to communicate with a pressurized source of gas 14. Second end 34 of input pressure line 30 communicates with an output junction 76 of output pressure line 70. In one embodiment, the gas is air delivered by a pressure regulating system 16. In an alternate embodiment, the gas includes an inert gas, such as argon. Use of inert gas may be preferred, for example, when a material to be processed with pressurized delivery system 10 is sensitive to air and oxidation of the material is a concern. For clarity, the following description only refers to using pressurized air, but it is understood that use of other gases, or combinations of gases, is within the scope of the present invention.

In one embodiment, a series of check valves are provided in input pressure line 30. The check valves include a low-pressure check valve 37 and a resister check valve 38. In addition, a filter 39 is provided in-line in input pressure line 30 after resister check valve 38. Filter 39 helps keep abrasive particulate material 12 from back streaming into resister check valve 38. An example of such a filter is a 9071-20-⅛, 25 micron filter manufactured by Arrow.

Low-pressure check valve 37 is provided in-line in input pressure line 30 to prevent back flow from storage container 20 into pressure regulating system 16 if a pressure drop occurs. Low-pressure check valve 37 has a low cracking pressure, for example, ⅓ pounds per square inch (psi), to reduce overall pressure drop in the system. An example of such a check valve is a SS-6C-⅓ check valve manufactured by Nupro. Resister check valve 38 is provided in-line in input pressure line 30 after low-pressure check valve 37. Resister check valve 38 produces a fairly constant pressure drop equal to its cracking pressure, for example, 10 psi. An example of such a check valve is a 4M-C4L-10-B check valve manufactured by Parker.

Resister check valve 38 develops a pressure in both input pressure line 30, between low-pressure check valve 37 and resister check valve 38, and fluidizing pressure line 40 which is higher than a pressure in input pressure line 30 after resister check valve 38. As such, a higher regulated pressure is developed before resister check valve 38 and a lower regulated pressure is developed after resister check valve 38. This higher pressure, before resister check valve 38, produces a drive pressure for fluidizing pressure line 40. A benefit of resister check valve 38 is that it automatically produces a fairly constant pressure drop regardless of output pressure settings. In an alternate embodiment, a first pressure regulator (not shown) is provided in-line in input pressure line 30 before fluidizing pressure line 40 and a second pressure regulator (not shown) is provided in-line in input pressure line 30 after fluidizing pressure line 40. The first and second pressure regulators, however, must each be adjusted in response to output pressure setting changes to develop the desired pressure drop within input pressure line 30 for producing drive pressure for fluidizing pressure line 40.

Fluidizing pressure line 40 has a first end 42 and a second end 44. First end 42 of fluidizing pressure line 40 communicates with an input junction 36 provided in input pressure line 30 between low-pressure check valve 37 and resister check valve 38. Second end 44 of fluidizing pressure line 40 communicates with inlet valve 50. As such, fluidizing pressure line 40 provides a by-pass flow path which is in parallel flow with input pressure line 30 from input junction 36. In one embodiment, a control valve 46 is provided in-line in fluidizing pressure line 40 before inlet valve 50. Control valve 46 is an adjustable valve used to set a desired flow rate, referred to as a fluidizing flow rate, of pressurized air supplied to inlet valve 50. An example of such a control valve is a MNV-1K needle valve manufactured by Clippard.

Figure 2:
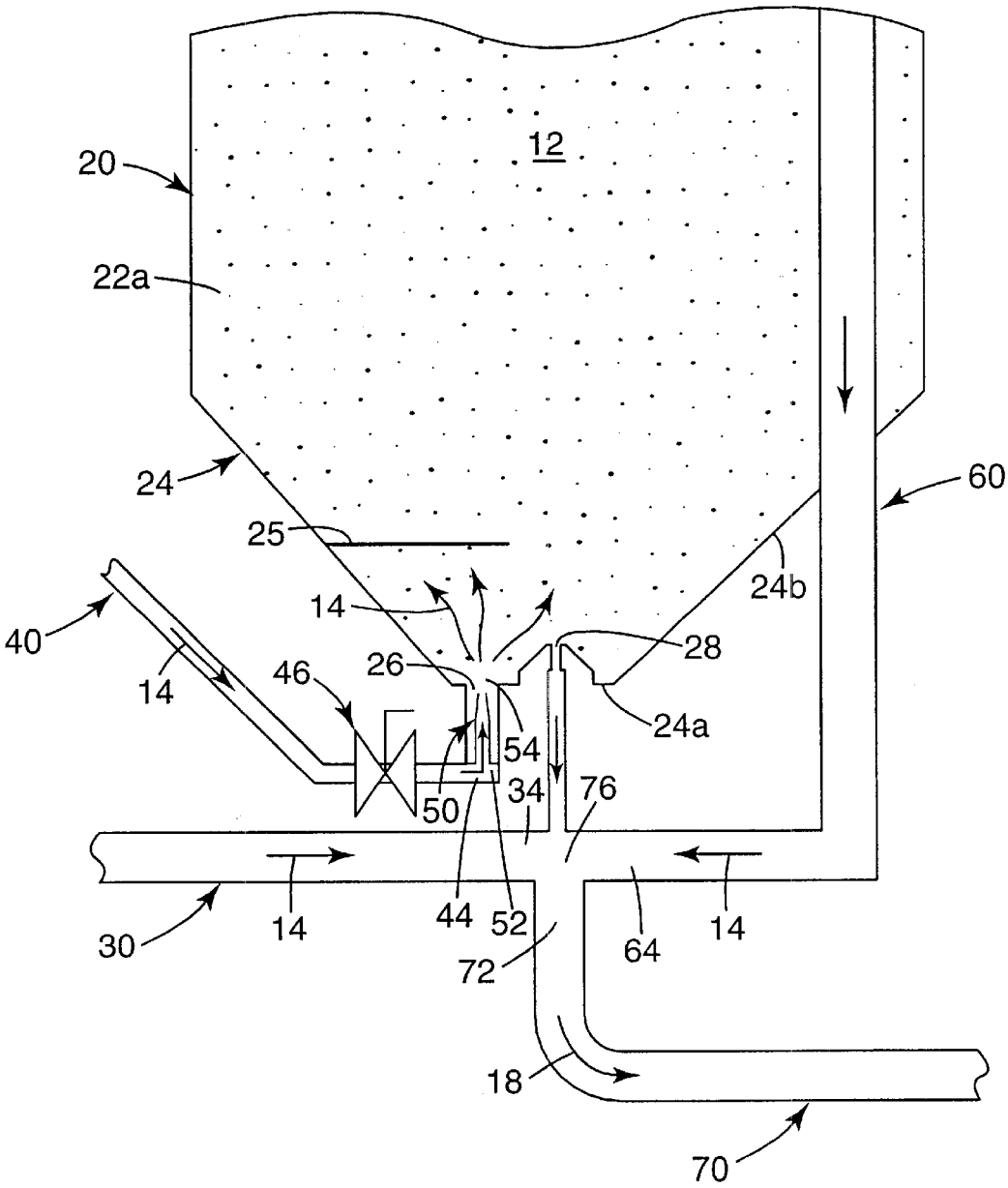
FIG. 2 is an eularged view of a portion of FIG. 1 illustrating portions of the pressurized delivery system including an inlet valve in an opened state.

Inlet valve 50 communicates with fluidizing pressure line 40 on an input side 52 (FIG. 2) and inlet opening 26 of storage container 20 on an output side 54 (FIG. 2). Inlet valve 50 has an opened state, illustrated in FIG. 2, and a closed state, illustrated in FIG. 3, depending on an operational state of pressurized delivery system 10. Inlet valve 50 is a one-way valve that permits substantially no flow in an upstream direction while permitting flow only in a downstream direction from fluidizing pressure line 40 to storage container 20. In one embodiment, inlet valve 50 is made of a flexible material, for example, rubber, and is commonly referred to as a flapper, or duckbill, check valve. The duckbill check valve is effective at creating a tight seal when closed despite communicating with abrasive particulate material 12. An example of such a check valve is a VL1490-102 check valve manufactured by Vernay Laboratories.

In an alternate embodiment, inlet valve 50 is a porous material (not shown) that permits air to flow from fluidizing pressure line 40 to storage container 20, but does not permit abrasive particulate material 12 to flow into fluidizing pressure line 40. The porous material suitably includes natural stones, micro-screen, filter cloth, or similar performing material. An example of such a material is a macroporous material formed of nylon and having a mesh opening of 8 microns manufactured by Spectrum.

Back-pressure pressure line 60 has a first end 62 and a second end 64. First end 62 of back-pressure pressure line 60 communicates with unoccupied portion 22*b* of interior space 22 of storage container 20. Second end 64 of back-pressure pressure line 60 communicates with output junction 76 of output pressure line 70. An inlet orifice 66 is provided at first end 62 of back-pressure pressure line 60 and has a diameter less than that of back-pressure pressure line 60. As such, inlet orifice 66 restricts input of air into back-pressure pressure line 60 and reduces sensitivity of the system to differing levels of abrasive particulate material 12 contained within storage container 20. It is theorized that back-pressure created by inlet orifice 66 increases a head on outlet opening 28 so that a head created by abrasive particulate material 12 itself is not the sole contributor to flow of abrasive particulate material 12 through outlet opening 28. Thus, variation of flow caused by differing levels of abrasive particulate material 12 within storage container 20 is reduced.

Output pressure line 70 has a first end 72 and a second end 74. First end 72 of output pressure line 70 communicates with second end 34 of input pressure line 30, second end 64 of back-pressure pressure line 60, and outlet opening 28 of storage container 20 at output junction 76. An abrasive pinch 77 is provided in output pressure line 70 and a vent pinch 78 is provided in a vent tube 79 communicating with output pressure line 70 before abrasive pinch 77. In addition, a nozzle 80 is provided at second end 74 of output pressure line 70. Nozzle 80 accelerates and directs abrasive particulate material 12 toward a surface to be processed. Abrasive pinch 77 and vent pinch 78 are used during operation of pressurized delivery system 10, as is known in the art.

In use, abrasive particulate material 12 is disposed within interior space 22 of storage container 20 to a level such that first end 64 of back-pressure pressure line 60 communicates with unoccupied portion 22*b* of interior space 22. In one illustrative embodiment, abrasive particulate material 12 is aluminum oxide. Pressurized air 14 is regulated and supplied, by pressure regulating system 16, to first end 32 of input pressure line 30, and first end 42 of fluidizing pressure line 40 after passing through low-pressure check valve 37. To operate pressurized delivery system 10, abrasive pinch 77 is opened, as illustrated in FIG. 1. Resister check valve 38, however, remains closed until a predetermined pressure differential, for example, 10 psi, occurs across resister check valve 38. This develops higher pressure before resister check valve 38 and produces drive pressure for fluidizing pressure line 40. When the predetermined pressure differential does occur across resister check valve 38, pressurized air 14 is released through resister check valve 38 and through filter 39 to output junction 76.

During operation, control valve 46 is adjusted to establish a desired fluidizing flow rate of pressurized air 14 to inlet valve 50. In one illustrative embodiment, with a standardized pressure of 4 psi, the fluidizing flow rate is adjusted to 6.0 standard cubic feet per hour (SCFH). The flow of pressurized air 14 causes inlet valve 50 to open, as illustrated in FIG. 2. As such, pressurized air 14, referred to as a fluidizing air stream, is released into interior space 22 of storage container 20, through inlet opening 26. Thereafter, baffle 25 disperses, or spreads out, pressurized air 14 released into interior space 22 of storage container 20 so as to more evenly distribute pressurized air 14 throughout base 24 of storage container 20. Since outlet opening 28 is adjacent to inlet opening 26, abrasive particulate material 12 adjacent outlet opening 28 is "fluidized." Essentially, abrasive particulate material 12 adjacent outlet opening 28 develops a fluidic trait and, as such, is maintained flowable through outlet opening 28. Thus, abrasive particulate material 12 is more accurately metered as it flows consistently through outlet opening 28 and to output junction 76 where it joins pressurized air 14 released through resister check valve 38.

While abrasive particulate material 12 flows through outlet opening 28, a portion of the fluidizing air stream released into storage container 20 by inlet valve 50 is released through outlet opening 28 and to output junction 76 with abrasive particulate material 12. A portion of the fluidizing air stream released into storage container 20 by inlet valve 50 also permeates through abrasive particulate material 12 to unoccupied portion 22*b* of interior space 22 where it is vented through back-pressure pressure line 60 to output junction 76. As such, abrasive particulate material 12 and the portion of the fluidizing air stream released through outlet opening 28 with abrasive particulate material 12, pressurized air 14 released through resister check valve 38, and the portion of the fluidizing air stream vented through back-pressure pressure line 60, come together at output junction 76 to form a pressurized abrasive particulate material/air mixture 18. As such, pressurized abrasive particulate material/air mixture 18 is supplied to output pressure line 70. Thereafter, pressurized abrasive particulate material/air mixture 18 is accelerated through nozzle 80.

Figure 3:
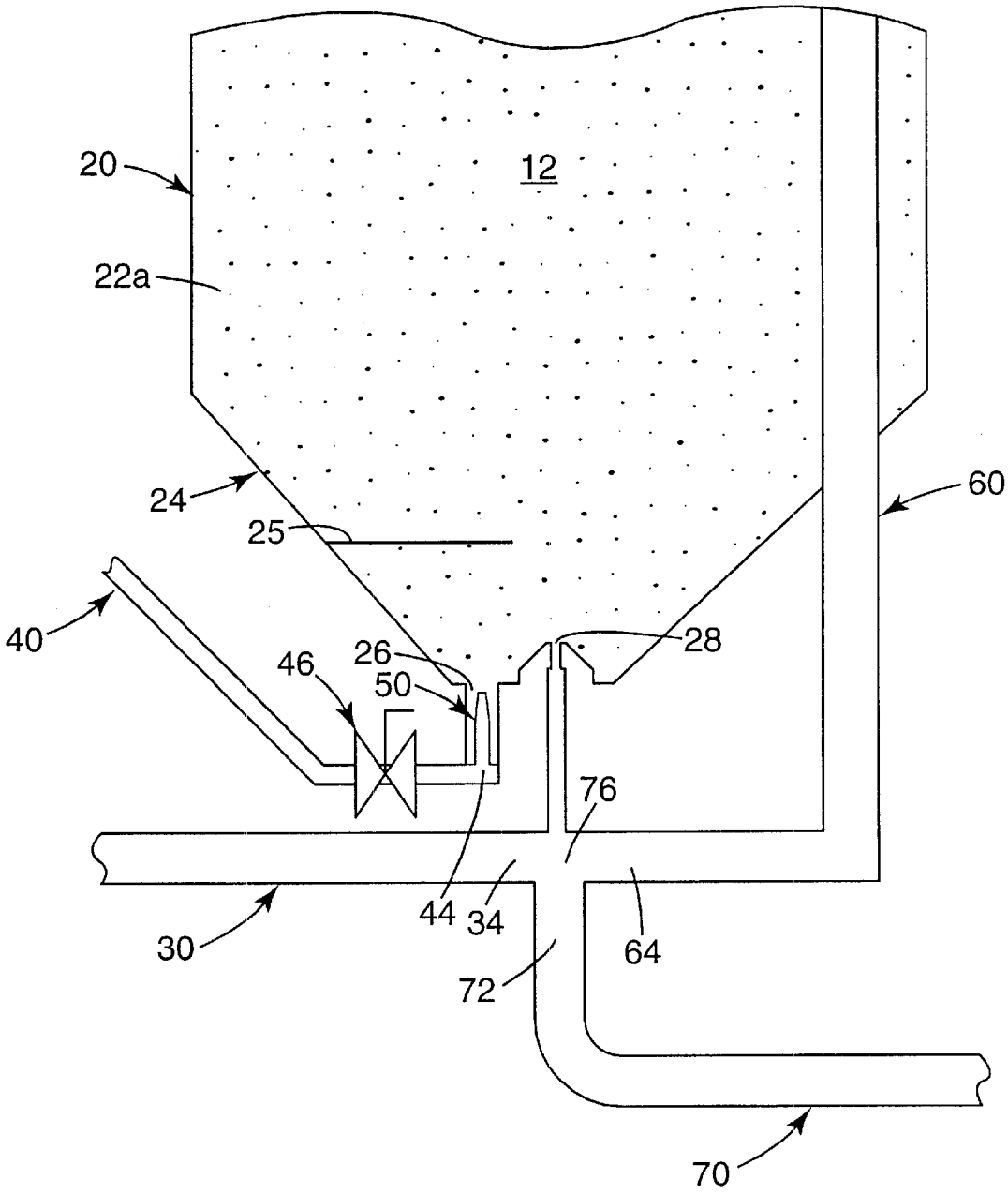
FIG. 3 is an enlarged view of a portion of FIG. 1 illustrating portions of the pressurized delivery system including an inlet valve in a closed state.

To discontinue operation, or develop a stand-by state, of pressurized delivery system 10, abrasive pinch 77 is closed. With abrasive pinch 77 closed, pressurized air 14 no longer flows through pressurized delivery system 10. Inlet valve 50, therefore, returns to the closed state, as illustrated in FIG. 3. Thus, a static mode of pressurized delivery system 10 is established.

Figure 4:
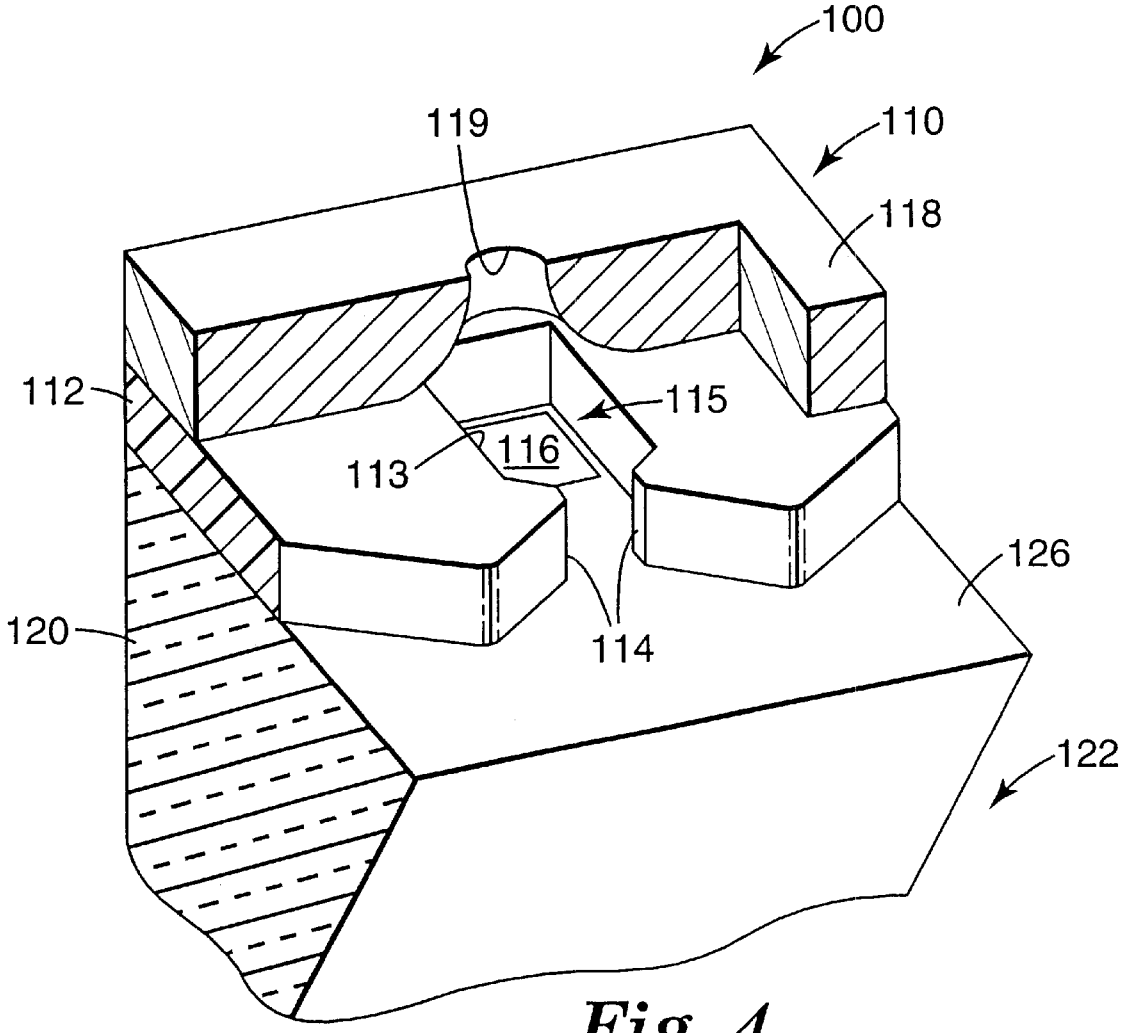
FIG. 4 is a perspective view of one embodiment of a portion of an ink-jet printhead including an ink fill slot formed in a silicon substrate by a pressurized delivery system according to the present invention.
Figure 5:
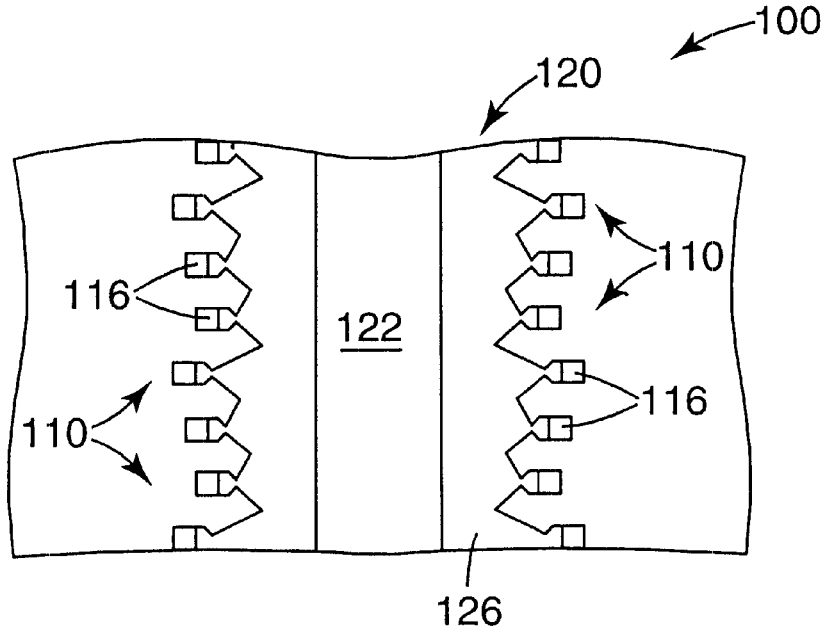
FIG. 5 is a top view of one embodiment of a portion of an ink-jet printhead including a plurality of printing elements formed on a silicon substrate and an ink fill slot formed in the silicon substrate by a pressurized delivery system according to the present invention.
Figure 6:
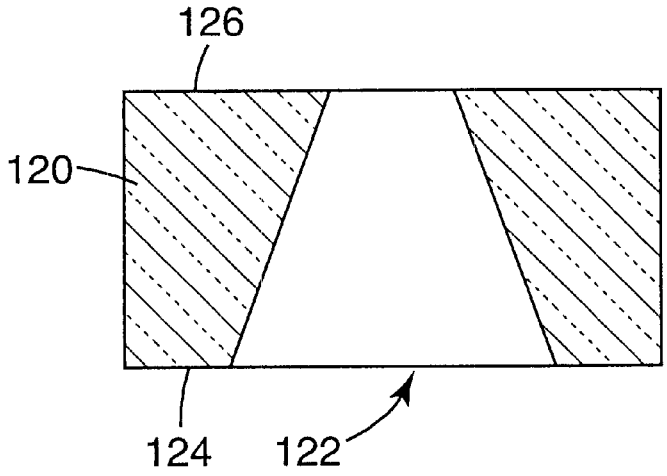
FIG. 6 is a cross-sectional view of one embodiment of an ink fill slot formed in a silicon substrate by a pressurized delivery system according to the present invention.

Referring to FIGS. 4–6, one illustrative application of pressurized delivery system 10 is for forming an ink fill slot 122 in a silicon substrate 120 of an ink-jet printhead 100 for an ink-jet printer (not shown). FIG. 4 illustrates a portion of ink-jet printhead 100 including a printing, or drop ejecting, element 110 formed on substrate 120. Ink fill slot 122, formed in substrate 120, provides a supply of ink (not shown) to a plurality of printing elements 110 as illustrated in FIG. 5. Although FIG. 5 illustrates one common configuration of a plurality of printing elements 110 including two parallel rows of printing elements 110 along ink fill slot 122, other configurations of printing elements 110 employed in ink-jet printers, including approximately circular and single row configurations, are within the scope of the present invention.

As illustrated in FIG. 4, printing element 110 includes a layer 112 having an ink feed channel 113 formed therein, a resistor 116 positioned within ink feed channel 113, and a nozzle plate 118 having a nozzle 119 formed therein. Ink feed channel 113 forms a drop ejection chamber 115 surrounding resistor 116 on three sides. Ink (not shown) is supplied from ink fill slot 122 to drop ejection chamber 115 through a pair of opposed projections 114 provided at an entrance to ink feed channel 113. Nozzle 119 is operatively associated with resistor 116 such that droplets of ink are ejected through nozzle 119 (e.g., normal to the plane of resistor 116) and toward a print medium (not shown) upon heating of a quantity of ink by resistor 116. As such, alphanumeric characters and graphics are formed on the print medium (not shown).

As illustrated in FIG. 6, substrate 120 has a first surface 124 and a second surface 126 upon which printing element 110 is formed. Second surface 126 is opposed to and substantially parallel with first surface 124. In one embodiment, substrate 120 comprises a single crystal silicon wafer, commonly used in the microelectronics industry. In addition, ink fill slot 122 communicates with both first surface 124 and second surface 126, and converges from first surface 124 toward second surface 126. As such, ink fill slot 122 provides a supply of ink (not shown) to second surface 126 and, therefore, printing element 110.

In accordance with the present invention, pressurized delivery system 10 is used to form ink fill slot 122 in silicon substrate 120 by directing a stream of pressurized abrasive particulate material/air mixture 18 at first surface 124 of silicon substrate 120. The stream of pressurized abrasive particulate material/air mixture 18 is directed at first surface 124 at least until ink fill slot 122 communicates with second surface 126 of silicon substrate 120. Since ink fill slot 122 provides the supply of ink to printing element 110 during the printing process, printing performance depends on uniformity of ink fill slot 122. A distance from an edge of ink fill slot 122 to drop ejection chamber 115, for example, determines how rapidly drop ejection chamber 115 can refill with ink after ink is ejected from drop ejection chamber 115 during the printing process. How rapidly drop ejection chamber 115 can refill with ink, in turn, effects a frequency of operation of printing element 110 and, therefore, printing speed. Compared with existing sandblasting systems employed for forming ink fill slot 122, pressurized delivery system 10 has been shown to significantly reduce size and shape variations of ink fill slot 122.

While pressurized delivery system 10 has been described and illustrated for use in forming ink fill slot 122 in silicon substrate 120 of ink-jet printhead 100 with pressurized abrasive particulate material/air mixture 18, it is apparent that pressurized delivery system 10 is useful for other cleaning, polishing, abrading or related operations. Other example embodiments of pressurized delivery system 10 are employed for removing paint, rust, or other foreign materials from surfaces including metal, concrete, or the like, cleaning or polishing jewelry or corroded articles, and/or abrading or polishing steel or other metal components.

Fluidizing pressure line 40 supplies pressurized air 14 to storage container 20 so as to fluidize a quantity of abrasive particulate material 12 contained therein. As such, abrasive particulate material 12 flows consistently through outlet opening 28 of storage container 20 to join pressurized air 14 supplied to output pressure line 70. Pressurized delivery system 10, therefore, provides a system for delivering abrasive particulate material under pressure such that more accurately metered flow of the abrasive particulate material from a storage container, through a metering orifice, and into an output pressure line is achieved.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A method of abrading a portion of a silicon substrate, the method comprising:

fluidizing abrasive particulate material with a first gas within a storage container, including releasing the first gas into the storage container through an inlet opening formed in a base of the storage container and discharging a quantity of the abrasive particulate material through an outlet opening formed in the base of the storage container;

combining the gas fluidized abrasive particulate material with a stream of a second gas to provide a stream of the gas fluidized abrasive particulate material; and directing the stream of the gas fluidized abrasive particulate material at the silicon substrate to abrade the portion of the silicon substrate.

2. The method of claim 1, wherein the abrasive particulate material includes at least one of sand, aluminum oxide, silicon carbide, quartz, and diamond dust.

3. The method of claim 1, wherein the first gas is air.

4. The method of claim 1, wherein the first gas is an inert gas.

5. The method of claim 1, wherein the second gas is air.

6. The method of claim 1, wherein the second gas is an inert gas.

7. The method of claim 1, wherein the first gas and the second gas are the same type of gas.

8. The method of claim 7, wherein the first gas and the second gas are air.

9. The method of claim 7, wherein the first gas and the second gas are an inert gas.

10. The method of claim 1, wherein directing the stream of the gas fluidized abrasive particulate material at the silicon substrate includes forming a slot in the silicon substrate.

11. The method of claim 1, wherein fluidizing the abrasive particulate material with the first gas includes fluidizing the abrasive particulate material within an interior space of the storage container adapted to contain the abrasive particulate material therein.

12. The method of claim 11, wherein fluidizing the abrasive particulate material within the interior space of the storage container includes dispersing the first gas within the interior space of the storage container.

13. The method of claim 12, wherein combining the gas fluidized abrasive particulate material with the stream of the second gas includes combining the gas fluidized abrasive particulate material with the stream of the second gas outside the interior-space of the storage container.

14. The method of claim 1, wherein combining the gas fluidized abrasive particulate material with the stream of the second gas includes combining the gas fluidized abrasive particulate material with the stream of the second gas outside of the storage container.

15. The method of claim 1, wherein fluidizing the abrasive particulate material with the first gas includes venting a portion of the first gas through and out of the storage container, and wherein combining the gas fluidized abrasive particulate material with the stream of the second gas includes combining the gas fluidized abrasive particulate material and the portion of the first gas with the stream of the second gas.

* * * * *